US005692750A

United States Patent [19]

Poole

[11] Patent Number: 5,692,750

[45] Date of Patent: Dec. 2, 1997

[54] GAME FOR SUGGESTING PERSONALITY TRAITS USING COLORIZED CARDS

[76] Inventor: Catherine Poole, 533 Calhoun St., Mishawaka, Ind. 46545

[21] Appl. No.: 736,953

[22] Filed: Oct. 25, 1996

[51] Int. Cl.[6] ..... A63F 9/18

[52] U.S. Cl. ..... 273/161; 273/292

[58] Field of Search ..... 273/292, 293, 273/294, 295, 307, 308, 161

[56] References Cited

U.S. PATENT DOCUMENTS

| | | | |
|---|---|---|---|
| D. 269,921 | 8/1983 | Young, Jr. et al. | 273/308 |
| 2,034,991 | 3/1936 | Salinger | 273/161 |
| 4,014,551 | 3/1977 | Alfonso | 273/161 |
| 4,779,870 | 10/1988 | Nichols | 273/161 |
| 4,893,819 | 1/1990 | Wright | 273/243 |
| 5,599,020 | 2/1997 | Fields | 273/161 |

OTHER PUBLICATIONS

"The Tarot", (New York: Arco Publishing Co.) 1978, pp. 72–75.

*Primary Examiner*—William M. Pierce
*Attorney, Agent, or Firm*—Baker & Daniels

[57] ABSTRACT

A card game which includes a set of cards, each having on one side solid color areas, dual color areas, or symbols, to provide a method for producing a hypothetical personality profile by sequentially arranging a specific number of the cards in a predetermined layout. Each card of the layout represents a personality trait according to the game instructions and each location of the layout represents a context, defined in the game instructions, for interpreting the personality trait definition.

9 Claims, 6 Drawing Sheets

| | | |
|---|---|---|
| | BODY CARD LOCATION (104) | |
| | Physical characteristics | |
| Location 1 (86) | Location 2 (88) | Location 3 (90) |
| Interpret card as relating to subject player's physical characteristics | Interpret card as relating to subject player's physical characteristics | Interpret card as relating to subject player's physical characteristics |
| | MIND CARD LOCATION (106) | |
| | Mental characteristics | |
| Location 4 (92) | Location 5 (94) | Location 6 (96) |
| Interpret card as relating to subject player's mental characteristics | Interpret card as relating to subject player's mental characteristics | Interpret card as relating to subject player's mental characteristics |
| | SPIRIT CARD LOCATION (108) | |
| | Spiritual characteristics | |
| Location 7 (98) | Location 8 (100) | Location 9 (102) |
| Interpret card as relating to subject player's spiritual characteristics | Interpret card as relating to subject player's spiritual characteristics | Interpret card as relating to subject player's spiritual characteristics |

| | | | |
|---|---|---|---|
| | PINK (20) | RED (22) | ORANGE (24) |
| | Secure | Assertive | Creative |
| YELLOW (26) | GREEN (28) | BLUE (30) | VIOLET (32) |
| Intelligent | Adaptable | Honest | Intuitive |
| PNK/VIO (40) | PNK/RED (42) | RED/PNK (44) | RED/ORG (46) |
| Introspective | Aloof | Nurturing | Idealistic |
| ORG/RED (48) | ORG/YEL (50) | YEL/ORG (52) | YEL/GRN (54) |
| Risk-taker | Industrious | Planner | Cautious |
| GRN/YEL (56) | GRN/BLU (58) | BLU/GRN (60) | BLU/VIO (62) |
| Compassionate | Balanced | Content | Independent |
| VIO/BLU (64) | VIO/PNK (66) | | |
| Self-confident | Enlightened | | |

Figure 3a

| | | |
|---|---|---|
| | BODY CARD LOCATION (104)<br>Physical characteristics | |
| Location 1 (86) | Location 2 (88) | Location 3 (90) |
| Interpret card as relating to subject player's physical characteristics | Interpret card as relating to subject player's physical characteristics | Interpret card as relating to subject player's physical characteristics |
| | MIND CARD LOCATION (106)<br>Mental characteristics | |
| Location 4 (92) | Location 5 (94) | Location 6 (96) |
| Interpret card as relating to subject player's mental characteristics | Interpret card as relating to subject player's mental characteristics | Interpret card as relating to subject player's mental characteristics |
| | SPIRIT CARD LOCATION (108)<br>Spiritual characteristics | |
| Location 7 (98) | Location 8 (100) | Location 9 (102) |
| Interpret card as relating to subject player's spiritual characteristics | Interpret card as relating to subject player's spiritual characteristics | Interpret card as relating to subject player's spiritual characteristics |

Figure 3c

| Location 1 (112) | Location 2 (114) | Location 3 (116) |
|---|---|---|
| Interpret card as relating to subject player's past personality | Interpret card as relating to subject player's current personality | Interpret card as relating to subject player's future personality |

Figure 3d

GAME FOR SUGGESTING PERSONALITY TRAITS USING COLORIZED CARDS

The present invention relates to a game in which a plurality of cards bearing various colors are considered by one player in specific sequential arrangements according to instructions to suggest the presence of common personality traits in that player or another player.

COPYRIGHT NOTICE

A portion of the disclosure of this patent document contains material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

BACKGROUND OF THE INVENTION

It is known that many people enjoy conversation directed toward observations and perceptions of their character or personality traits. New games that stimulate such conversation and promote introspection are always desirable since these activities provide entertaining diversions from daily routine and may produce positive changes in the person under discussion as a result of deliberative self-analysis or collaborative examination. A game which promotes such constructive reflection and interaction in a non-competitive context follows.

SUMMARY OF THE INVENTION

The present invention provides a game employing a deck of twenty-four cards accompanied by instructions which set out sequential arrangements for the cards and personality characteristics corresponding to the color of the cards to advantageously provide a personality profile of a subject player. Seven of the twenty-four cards contain a solid colored area upon one side. Fourteen cards contain two colored areas. The remaining three cards contain distinct symbols. Each colored area and each of the three symbols corresponds to a provided description of a personality trait or attribute.

The game is played by shuffling the cards, then laying out a specified number of cards in a predetermined sequence and arrangement. Each location in the arrangement has a predetermined connotation as described in the instruction set which provides contextual relevance to the personality trait corresponding to the card occupying the location. A hypothetical, comprehensive description of the subject player's personality is ascertained by reviewing the personality trait description corresponding to each card with the understanding that the trait description is modified by the connotation of the location containing the card. This hypothetical personality description may be compared to and considered in conjunction with the subject player's actual personality.

Accordingly, it is an object of the present invention to provide a non-competitive card game which is intellectually stimulating and interesting.

Another object of the present invention is to provide a method for compiling a hypothetical personality profile.

BRIEF DESCRIPTION OF THE DRAWINGS

The above-mentioned and other objects and advantages of this invention, and the manner of attaining them, will become more apparent and the invention will be better understood by reference to the following description of embodiments of the invention taken in conjunction with the accompanying drawings, wherein:

FIG. 3*a* is a table of definitions corresponding to the cards depicted in FIG. 1 with reference numbers added;

FIG. 3*c* is a table of definitions corresponding to the arrangement depicted in FIG. 2*b* with reference numbers added; and FIG. 3*d* is a table of definitions corresponding to the arrangement depicted in FIG. 2*c* with reference numbers added.

Figure 1:
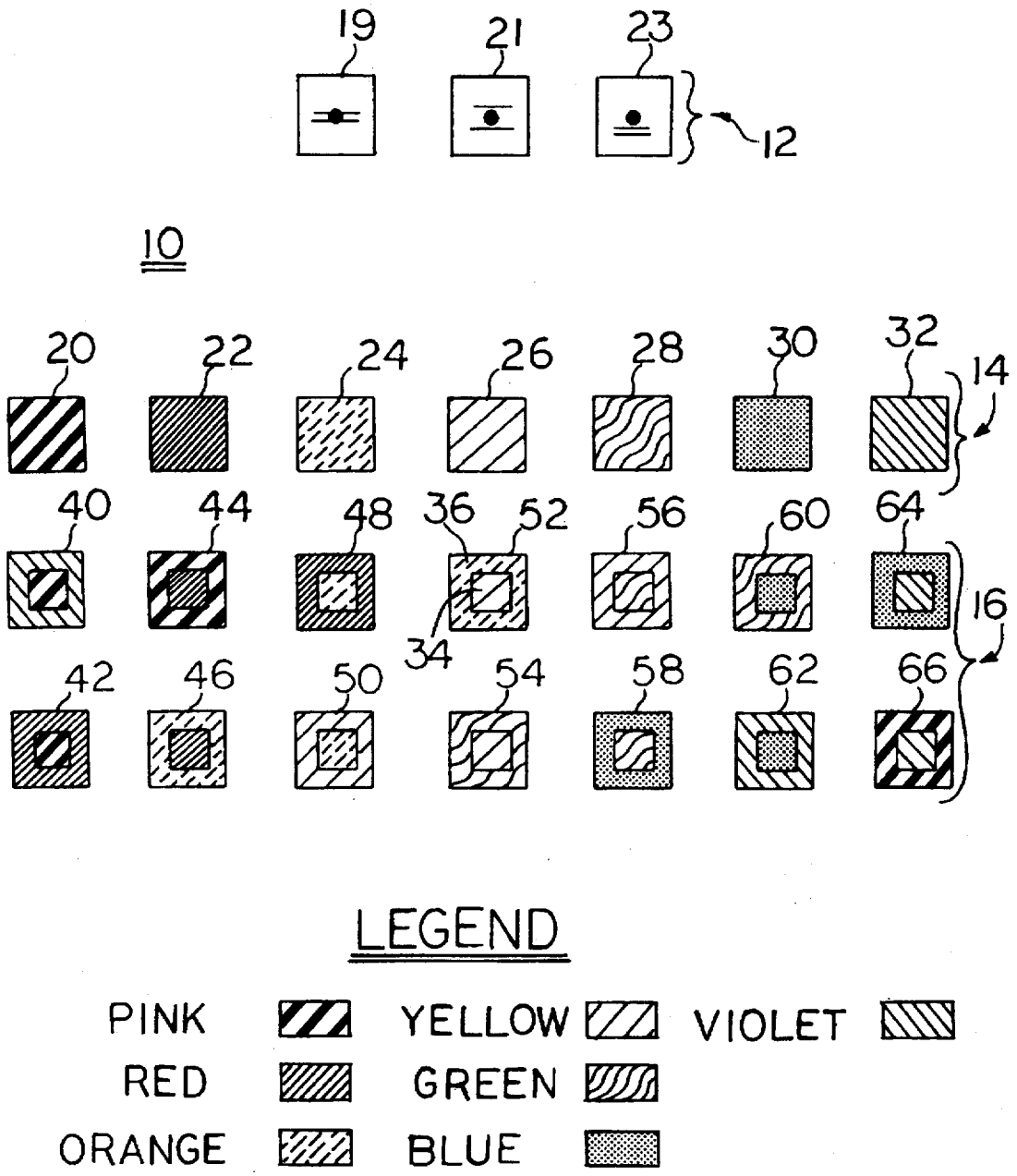
FIG. 1 is a top plan view of a set of twenty-four cards according to the present invention.

Corresponding reference characters indicate corresponding parts throughout the several views. Although the drawings represent embodiments of the present invention, the drawings are not necessarily to scale and certain features may be exaggerated in order to better illustrate and explain the present invention.

DESCRIPTION OF THE INVENTION

The embodiments herein described are not intended to be exhaustive or to limit the invention to the precise forms disclosed. Rather, the embodiments selected for the description are disclosed so that others skilled in the art may utilize their teachings.

FIG. 1 shows the card set 10 of the present invention. Card set 10 includes front sided cards 12 having indicator faces, cards 14 having solid color faces and cards 16 having dual color faces. The back side (not shown) of each card should be blank or uninformative so as to provide no visual indication of the content of the front side of the card. The size and shape of the cards and material from which they are made are of no particular significance and constitute no part of this invention, except that all cards should be of a similar size so as to be indistinguishable from the back side. Indicator cards 12 include a body card 19, a mind card 21 and a spirit card 23, each bearing a distinct stylized symbol as shown in FIG. 1. Each of the seven color cards 14 bears a distinct color, illustrated by a distinct pattern as shown in FIG. 1. The color cards include the solid colors of pink 20, red 22, orange 24, yellow 26, green 28, blue 30 and violet 32.

Dual color cards 16 contain an interior area 34 containing one of the seven colors of the solid color cards 14 surrounded by a border area 36 containing a second color of one of the color cards 14 which is different from the color in the interior area 34. Dual color cards 16 contain the following color combinations: pink surrounded by violet (40), pink surrounded by red (42), red surrounded by pink (44), red surrounded by orange (46), orange surrounded by red (48), orange surrounded yellow (50), yellow surrounded by orange (52), yellow surrounded by green (54), green surrounded by yellow (56), green surrounded by blue (58), blue surrounded by green (60), blue surrounded by violet (62), violet surrounded by blue (64), and violet surrounded by pink (66). The shape of interior area 34 and the shape of border area 36 of dual colored cards 16 is of no particular significance.

Figures 2A, 2B, 2C:
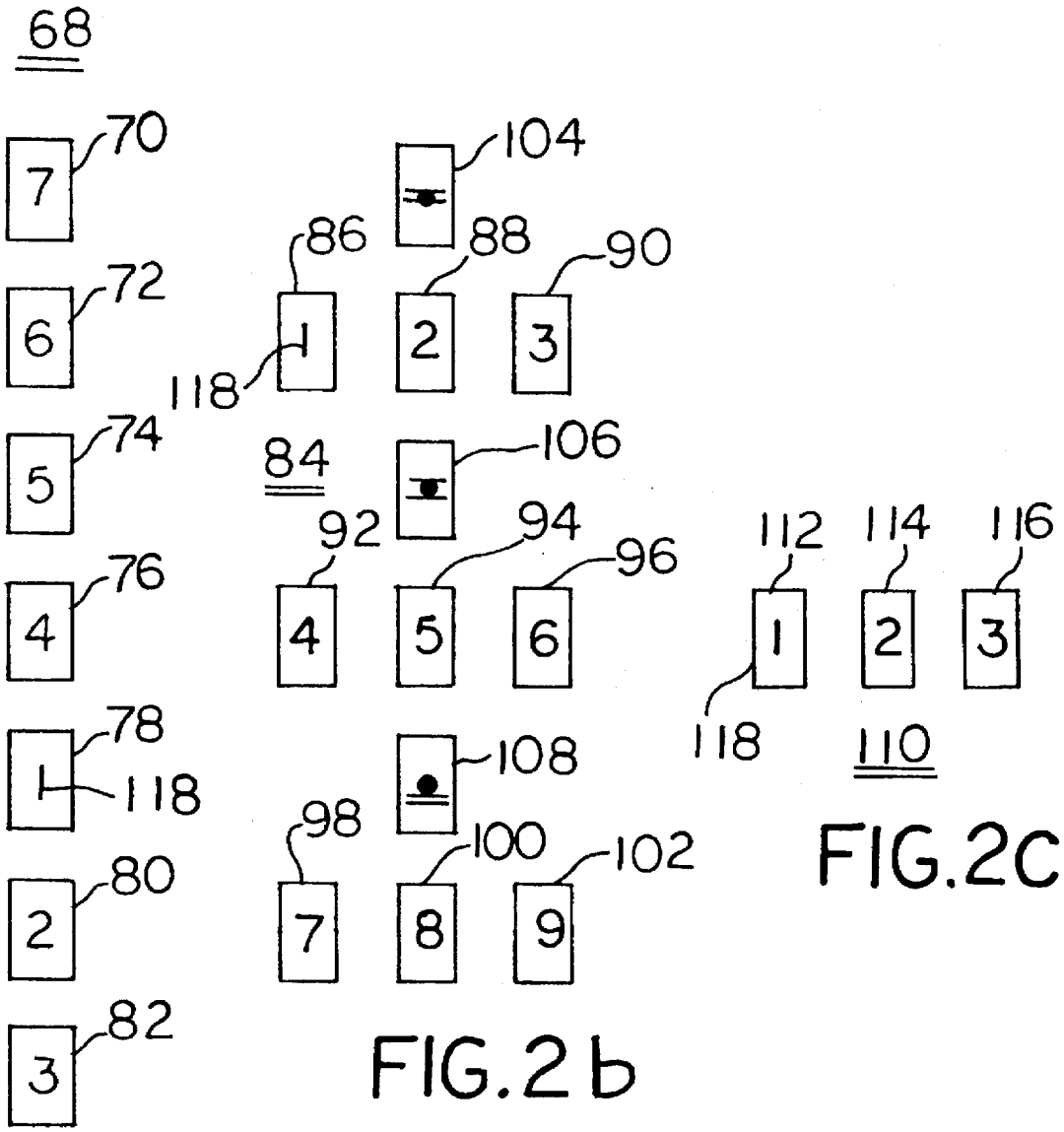
FIG. 2*a* is a top plan view of a card arrangement pursuant to the teachings of the present invention showing the sequence in which the arrangement is laid out and the relative location of the cards.
FIG. 2*b* is a top plan view of another card arrangement.
FIG. 2*c* is a top plan view of yet another card arrangement.

FIGS. 2a–c show three arrangements into which cards from card set 10 of the present invention are organized during play. FIG. 2a depicts the comprehensive arrangement 68 containing seven card locations 70, 72, 74, 76, 78, 80, 82 (no indicator cards 12). FIG. 2b depicts the distributive arrangement 84 containing nine locations 86, 88, 90, 92, 94, 96, 98, 100, 102 for solid color cards 14 or dual colored cards 16 and three locations 104, 106, 108 for indicator cards 12. FIG. 2c depicts the abbreviated arrangement 110 containing three locations 112, 114, 116 for solid color cards 14 or dual colored cards 16. A numeric indicator 118 is located for illustrative purposes in each of the locations shown in FIGS. 2a–c. Numeric indicators 118 correspond to the sequence in which the cards are organized or laid out for each arrangement 68, 84, 110.

Figure 3B:
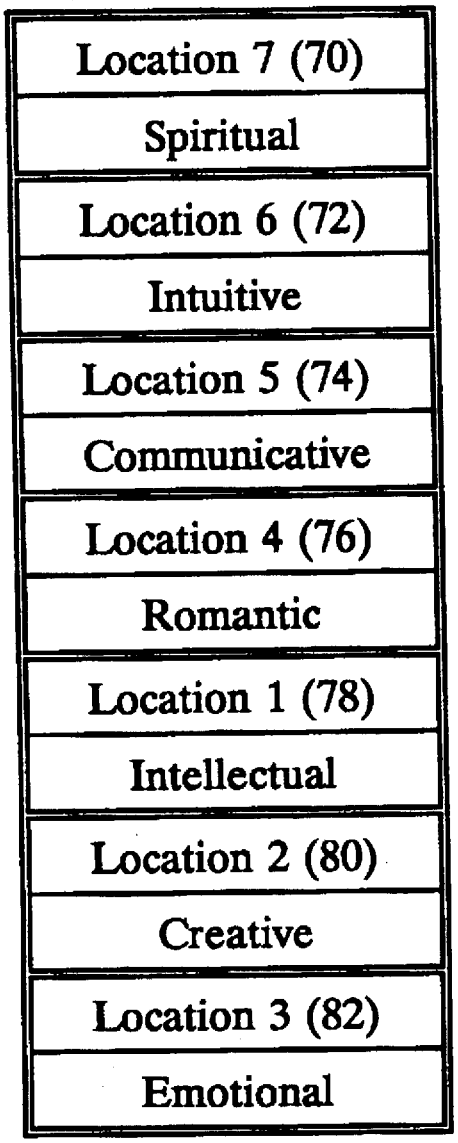
FIG. 3*b* is a table of definitions corresponding to the arrangement depicted in FIG. 2*a* with reference numbers added.

FIG. 3a is a table of personality traits corresponding to solid color cards 14 and dual color cards 16. FIG. 3b is a table defining the personality traits associated with each of the seven locations of the comprehensive arrangement 68 of FIG. 2a. FIG. 3c is a table defining the context in which each of the nine locations of the distributive arrangement 84 of FIG. 2b should be interpreted. Likewise, FIG. 3d is a table defining the context in which each of the three locations of the abbreviated arrangement 110 of FIG. 2c should be interpreted.

MODE OF OPERATION

The method for producing a hypothetical personality profile according to the present invention is performed by first identifying a subject player to be described by the hypothetical personality profile. At the conclusion of the arrangement construction as described below, the subject player may provide for discussion an analysis of the resulting personality profile as compared to the subject player's perceived actual personality. Of course, other players familiar with the personality traits of the subject player may likewise offer a critique of the hypothetical profile in light of their knowledge to further assess the accuracy of the method of the present invention and to further stimulate conversation.

In an exemplary embodiment of the invention, the subject player randomly shuffles card set 10 face down. Card set 10 may include all seven solid color cards 14, all fourteen dual color cards 16, and all three indicator cards 12, depending upon the desired arrangement as explained below. The card arrangement 68, 84, or 110 is then selected according to the preference of the players. For the purposes of explanation, assume that comprehensive arrangement 68 is selected. Solid color cards 14 and dual color cards 16 are included in card set 10 for laying out comprehensive arrangement 68. Indicator cards 19, 21, 23 may be optionally included. Cards are dealt by the player from the card set 10 and placed on a surface in the sequence and relative orientation shown in FIG. 2a with the colored areas of each card facing upwardly. The first card laid out is placed in location 1 (78), the second in location 2 (80), the third in location 3 (82), the fourth in location 4 (76), the fifth in location 5 (74), the sixth in location 6 (72), and the seventh in location 7 (70).

After comprehensive arrangement 68 is completely laid out, the card definition table of FIG. 3a and the location definition table of FIG. 3b are both consulted to provide personality profile components for each card/location combination in turn. For example, if solid color card 30 (bearing the color blue) was placed in location 1 (78), then a resulting personality profile component interpretation is that the intellectual element (the contextual connotation provided by location 1) of the subject player's personality is at least partially characterized by the personality trait description "honest" (the definition of solid color card 30). Of course, variations of the personality profile component interpretation are possible depending in part upon the subjective understanding of the definitions provided in the instructions and depicted in FIGS. 3a and 3b. If location 2 (80) in arrangement 68 contained dual color card 40 (bearing the colors pink surrounded by violet), then a resulting personality profile component interpretation is that the creative element of the subject player's personality is characterized by the personality trait description "introspective." The process of associating personality trait descriptions with elements of the subject player's personality by consulting the tables of FIGS. 3a and 3b is repeated in sequence by location number until each of the seven components is identified and a comprehensive, hypothetical personality profile is constructed.

Finally, the entire hypothetical profile may be discussed and considered in view of the analysis provided by the subject player and other informed players and observers. By verbalizing a critique of the hypothetical profile and listening to the alternative analyses of others, the subject player is provided an opportunity to gain an enhanced understanding of his or her actual personality through deliberate introspection.

The arrangements illustrated in FIGS. 2b and 2e are constructed and interpreted using similar procedures. Referring to FIGS. 2b and 3c, distributive arrangement 84 of FIG. 2b first requires that indicator cards 19, 21, 23 be arranged in locations 104, 106, 108 respectively. The remainder of card set 10 is shuffled and located by the player in the order indicated, and interpreted as described above. Distributive arrangement 84 differs from comprehensive arrangement 68 in that the contextual relevance of locations 86, 88, 90, 92, 94, 96, 98, 100, 102 of distributive arrangement 84 is provided by the indicator card 12 associated with the location, rather than the definitions provided in the table of FIG. 3b. Thus, for location 1 (86), location 2 (88), and location 3 (90), the personality trait descriptions of FIG. 3a associated with solid color cards 14 and dual color cards 16 are to be interpreted as relating to the subject player's physical characteristics as explained in FIG. 3c. For location 4 (92), location 5 (94), and location 6 (96), the trait descriptions are interpreted as relating to the subject player's mental characteristics. Similarly, for location 7 (98), location 8 (100), and location 9 (102), the trait descriptions relate to the subject player's spiritual characteristics. Once a complete, hypothetical personality profile is constructed, the players discuss the resulting profile as described in the context of comprehensive arrangement 68 above.

The contextual relevance of locations 112, 114, and 116 comprising abbreviated arrangement 110 is shown in FIG. 3d. After card set 10 is shuffled and placed by the player according to the procedure described above in the order indicated, the hypothetical personality profile is determined by interpreting the personality trait description from FIG. 3a corresponding to card located in location 1 (112) as relating to the subject player's predominant past personality trait, the trait description corresponding to location 2 (114) as the subject player's currently predominant personality trait, and the trait description corresponding to location 3 (116) as the subject player's anticipated predominant personality trait.

The resulting hypothetical evolution of personality traits is considered in view of information provided by the subject player and other players as described above.

While this invention has been described as having exemplary embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. Apparatus for producing a profile to describe the personality traits of a player, said apparatus comprising: a plurality of cards including, seven solid color face cards, each said solid color face card being of a different color selected from the group of colors including pink, red, orange, yellow, green, blue, and violet, and fourteen dual color face cards, each said dual color face card having a first colored area and a second colored area upon its said printed side, each said first colored area characterized by one color of said group of colors, each said second colored area characterized by another color of said group of colors, said other color being different from said one color for each dual color face card;

a table of personality trait descriptions, each of said plurality of cards representing one of said personality trait descriptions;

an arrangement in which said cards can be placed having a plurality of locations for correspondingly receiving a number of said cards face up, said number of cards randomly selected from said plurality of cards; and a table of context definitions, each of said plurality of locations representing one of said context definitions: whereby said selected number of said cards when sequentially placed in said arrangement at said plurality of locations are each indicative of a said corresponding personality trait description modified by a said context definition corresponding to the location of the card to produce a components of said profile, said profile constituting a combination of such components.

2. The apparatus of claim 1 wherein said first colored area of each of said dual color face cards is surrounded by said second colored area.

3. The apparatus of claim 1 wherein said arrangement has seven aligned locations.

4. The card game of claim 3 wherein the seventh selected card is at a location at one end of said arrangement, the sixth selected card is at a location next to said first-mentioned location, the fifth selected card is at a location next to said second-mentioned location, the fourth selected card is at a location next to said third-mentioned location, the first selected card is at a location next to said fourth-mentioned location, the second selected card is at a location next to said fifth-mentioned location, and the third selected card is at a location next to said sixth-mentioned location.

5. The apparatus of claim 1 wherein said arrangement has at least three locations.

6. The apparatus of claim 1 wherein a first pair of said dual color face cards have said first colored areas characterized by pink, a second pair of said dual color face cards have said first colored areas characterized by red, a third pair of said dual color face cards have said first colored areas characterized by orange, a fourth pair of said dual color face cards have said first colored areas characterized by yellow, a fifth pair of said dual color face cards have said first colored areas characterized by green, a sixth pair of said dual color face cards have said first colored areas characterized by blue, and a seventh pair of said dual color face cards have said first colored areas characterized by violet, said second colored area of one said dual color face card of each said pair being characterized by a color which is different from the color characterizing said second colored area of the other said dual color face card of said pair.

7. The apparatus of claim 6 wherein the second colored areas of said first pair are respectively characterized by violet and red, the second colored areas of said second pair are respectively characterized by pink and orange, the second colored areas of said third pair are respectively characterized by red and yellow, the second colored areas of said fourth pair are respectively characterized by orange and green, the second colored areas of said fifth pair are respectively characterized by yellow and blue, the second colored areas of said sixth pair are respectively characterized by green and violet, and the second colored areas of said seventh pair are respectively characterized by blue and pink.

8. The apparatus game of claim 1 further comprising a first indicator card bearing a first symbol on its said printed side, a second indicator card bearing a second symbol on its said printed side, and a third indicator card bearing a third symbol on its said printed side, each of said symbols having a distinct and different connotation of meaning, said indicator cards being used with said plurality of cards to produce said profile.

9. The apparatus of claim 8, wherein said arrangement has twelve card locations, one of said indicator cards being associated with each of three of said face cards.

* * * * *